United States Patent [19]

Rowse et al.

[11] Patent Number: 4,785,945

[45] Date of Patent: Nov. 22, 1988

[54] ASSEMBLY OF VARIABLE-WIDTH GRAVITY-FEED BEVERAGE-CONTAINER DISPENSER ARRAY FROM SINGLE-LANE COMPONENTS

[75] Inventors: Samuel B. Rowse, Brookline; Robert Y. Grant, Mason, both of N.H.

[73] Assignee: New England Apple Products Co., Inc., Littleton, Mass.

[21] Appl. No.: 64,218

[22] Filed: Jun. 18, 1987

[51] Int. Cl.[4] ..... A47F 1/00

[52] U.S. Cl. ..... 211/59.2; 108/64; 312/111; 312/42

[58] Field of Search ..... 108/64, 65; 24/697; 312/42, 45, 72, 111; 220/23.2, 23.4; 52/134, 136; 206/504; 211/59.2, 49.1, 11

[56] References Cited

U.S. PATENT DOCUMENTS

| | | | |
|---|---|---|---|
| 2,103,408 | 12/1937 | Eddy | 312/111 |
| 2,723,484 | 11/1955 | Nelson, Jr. | 220/23.4 X |
| 2,833,607 | 5/1958 | Mackintosh | 108/64 |
| 4,243,279 | 1/1981 | Ackeret | 312/111 X |
| 4,356,923 | 11/1982 | Young et al. | 211/59.2 |
| 4,429,796 | 2/1984 | Sussman | 211/11 |
| 4,438,852 | 3/1984 | Evans | 211/11 |
| 4,685,574 | 8/1987 | Young et al. | 211/59.2 |
| 4,690,287 | 9/1987 | Fershko et al. | 211/49.1 |
| 4,698,828 | 7/1987 | Young et al. | 312/42 X |

*Primary Examiner*—Peter A. Aschenbrenner
*Attorney, Agent, or Firm*—James E. Mrose

[57] ABSTRACT

In the rack mounting and display of chilled beverage containers, for ready access and withdrawals by retial customers, the gravity-feed forwardly-inclined shelving having multiple parallel lanes for upright presentation of the containers is formed by combinations of laterally-interlocked identical molded-plastic modules. Each elongated narrow module is of a high-strength ribbed construction and exhibits an upstanding narrow guide wall fully along one edge; when several such modules are joined side-by-side, via separable fastening provisions such as those composed of integral pegs depending from along one edge and accommodating recesses disposed in a narrow ledge along the other, the single guide walls cooperate to define the individual lanes or paths along which the containers must slide from back to front. Widths of the shelf assemblies are determined by the numbers of modules which are locked together, thereby allowing for fits within different widths of available space, and for adjustments of displays to offer something other than a standard number of selections.

3 Claims, 3 Drawing Sheets

ASSEMBLY OF VARIABLE-WIDTH GRAVITY-FEED BEVERAGE-CONTAINER DISPENSER ARRAY FROM SINGLE-LANE COMPONENTS

BACKGROUND OF THE INVENTION

The present invention relates to improvements in gravityfeed dispensers of containers, and, in one particular aspect, to unique and advantageous shelving, adapted for rack mounting and retail dispensing of bottled beverages and the like, which may be assembled to desired widths and with different numbers of product lanes from molded-plastic modules of identical economical and uncomplicated construction.

It has become a popular practice, especially in the merchandizing of small bottles and cans of beverages, to provide a rack structure which accommodates the loading of a number of like items into the rear of each of several assigned lanes or tracks of each of several stacked forwardly-slanted shelves, whence the items will slide downwardly and forward incrementally toward frontal stopped positions as customers sequentially remove those cans or bottles which happen to be in the foremost positions. Such shelving is commonly designed to provide flooring under the items, and/or to provide rail-like supports for their sliding movements, as well as to separate the items in a plurality of side-by-side lanes on each shelf. Materials such as rod- or wire-like metal, stamped sheet metal, and plastics, have been used to fabricate such shelves, and it has also been known to telescope the multi-lane shelving for lengthwise adjustments which adapt it to use with racks of various depths. In other instances, where the items to be dispensed from different lanes are not of the same width, provision has been made for adjustment of lane widths by way of laterally-movable guides or lane dividers. Containers of chilled beverages are often displayed in and dispensed from refrigerated compartments having glass doors movable to allow customer access to stacks of the rack-mounted sloping shelves.

Although laterally-adjustable dividers may enable the user to vary the number and location of lanes associated with each shelf, the overall shelf widths are not actually changed in that process, and the need to position and fasten the movable dividers involves complexity and labor which it would be better to avoid.

SUMMARY OF THE INVENTION

In a preferred expression of the present teachings, each of the vertically-stacked forwardly-inclined shelves of a display-and-dispensing rack for beverage containers is pieced together as a laterally-interlocked assemblage of identical molded-plastic modular elements which form the individual lanes for gravity-induced forward sliding of containers arrayed upright in rows lengthwise along the lanes. Each modular element is relatively narrow, and elongated, with proportions suited to its intended support, from below, of the bases of a number of like containers, such as bottles, and has a short upstanding wall at its front to act as a stop for the foremost bottle without at the same time obscuring the bottle or preventing its withdrawal forwardly when a customer first lifts it slightly. Along one of its side edges, the modular element is bordered by a narrow upstanding guide wall, which, from one side, tends to confine supported bottles to the slide lane formed by that element. Depending from near that same edge are several longitudinally-spaced pegs dimensioned to make tight fit within recesses like those which appear in a narrow ledge which forms the opposite side edge of the modular element; when two such elements are hooked together in side-by-side parallel relationship, the downwardly-projecting pegs of one will mate and become firmly engaged within the accommodating ledge recesses of the other, serving to lock them together laterally. The upstanding narrow guide wall of the second of the two interlocked modular elements is then in position to act to confine supported bottles to the slide lane of the first element, from the side opposite that of the guide wall of the first element. The side ledge of one element is dimensioned to fit beneath and abut with the under side of the next-adjoining side of another element, and so on, to facilitate the fashioning of relatively rigid broad shelves of different widths, depending upon the numbers of modular elements which are locked together. Beneath their forward ends, the modular elements are relieved to form catches which prevent forward sliding of the elements themselves as they rest upon and slope from front and rear cross-members of metal rack framing. Except near its side edges and front, each module is mainly of a ribbed open-mesh type construction which provides strength while allowing for beneficial circulation of chilled air in a cooler, and each is a one-piece molded-plastic item, inclusive of its locking pegs, such that no accessories are required to form the multi-lane selectable-width shelf assemblies.

Accordingly, it is one of the objects of this invention to promote novel and advantageous fabrication of variable-width shelving for gravity-feed dispensers of beverage containers, as aided by unique individual molded-plastic modules which lock together to form the shelving lanes on which the containers are supported, conveyed and displayed.

A further object is to provide unique interfitting modular elements of identical unitary molded-plastic construction which may be joined without resort to accessory fasteners to produce selectable-width shelving having lanes for sliding delivery of beverage containers upon a dispensing and display rack.

BRIEF DESCRIPTION OF THE DRAWINGS

Although the aspects of this invention which are considered to be novel are expressed in the appended claims, further details as to preferred practices and as to further objects and features thereof may be most readily comprehended through reference to the following detailed description when taken in connection with the accompanying drawings, wherein:

DETAILED DESCRIPTION OF THE PREFERRED EMBODIMENTS

Figure 1:
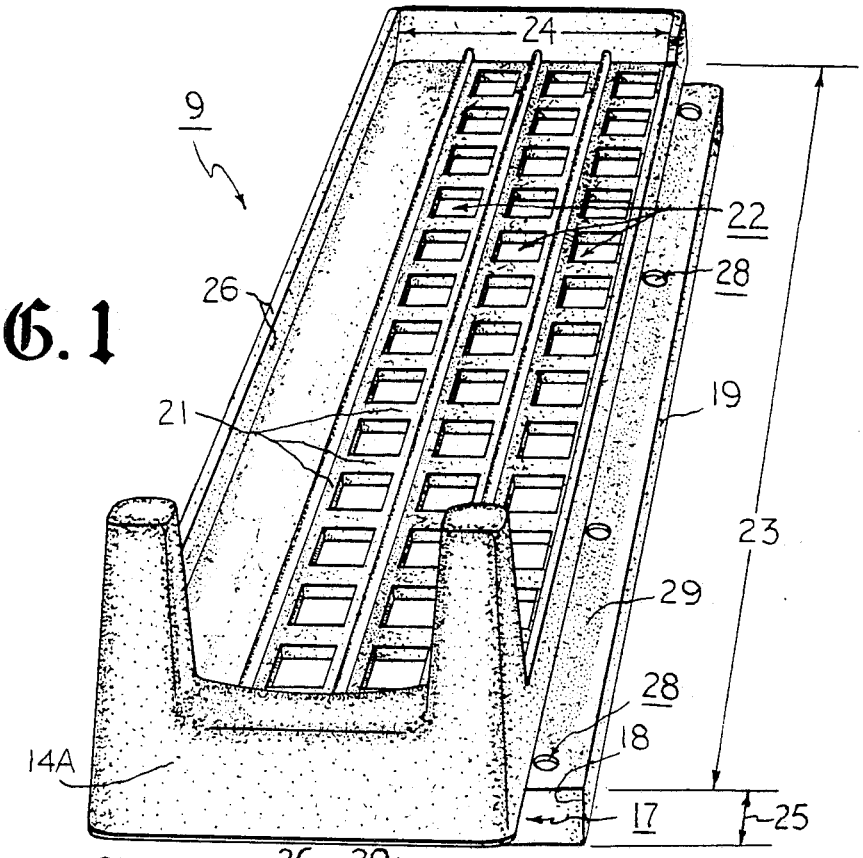
FIG. 1 provides a perspective view of a molded-plastic single-lane modular element constructed for side-by-side interlocking with similar elements to develop a desired width of multi-lane gravity-feed dispenser of beverage containers.
Figure 2:
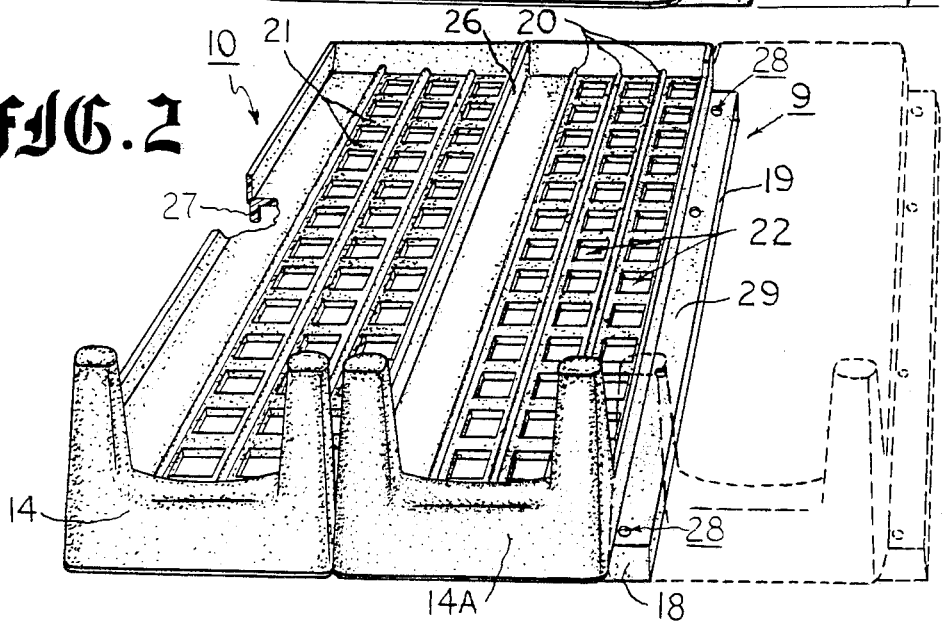
FIG. 2 illustrates similar elements in laterally-interlocked relationship, one of the elements being broken away to reveal an integral depending locking peg, and the outline of another of the elements being shown in dashed linework.
Figure 7:
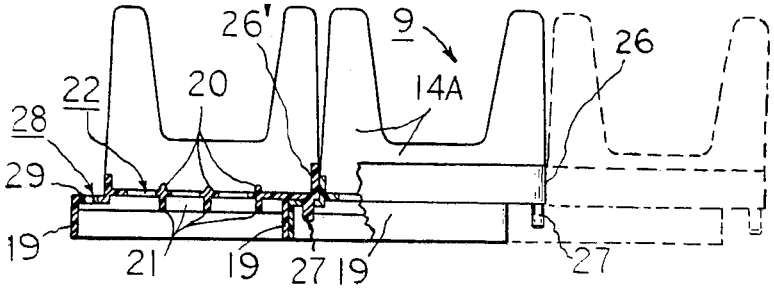
FIG. 7 illustrates interlocked elements of a multi-lane dispenser, generally like that of FIG. 2, from the rear, with portions of two of the elements being broken away, and the third being outlined in dashed linework, to expose constructional and interlocking features.
Figure 3:
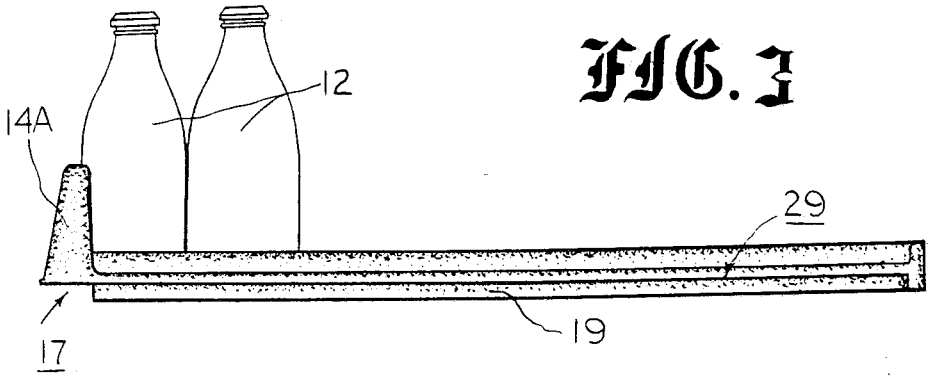
FIG. 3 is a side elevational view of an element like that of FIG. 1, viewed from the right in relation to the FIG. 1 illustration, partly loaded with a pair of beverage bottles.
Figure 4:
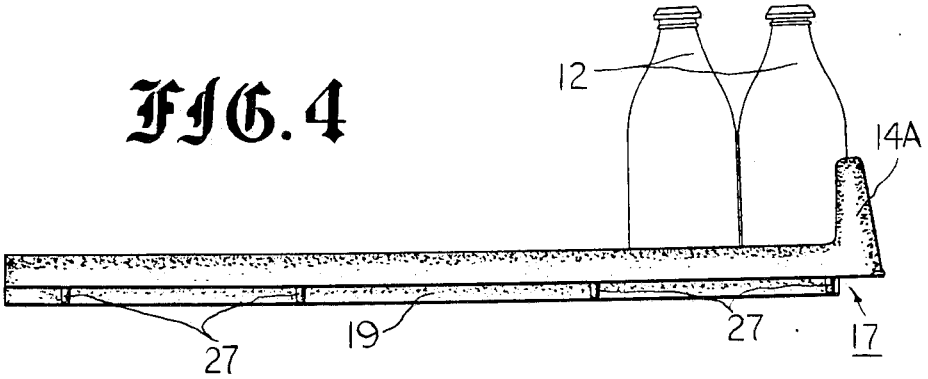
FIG. 4 is a side elevational view of the same partly-loaded element shown in FIG. 3, viewed from the left in relation to the FIG. 1 illustration.
Figure 8:
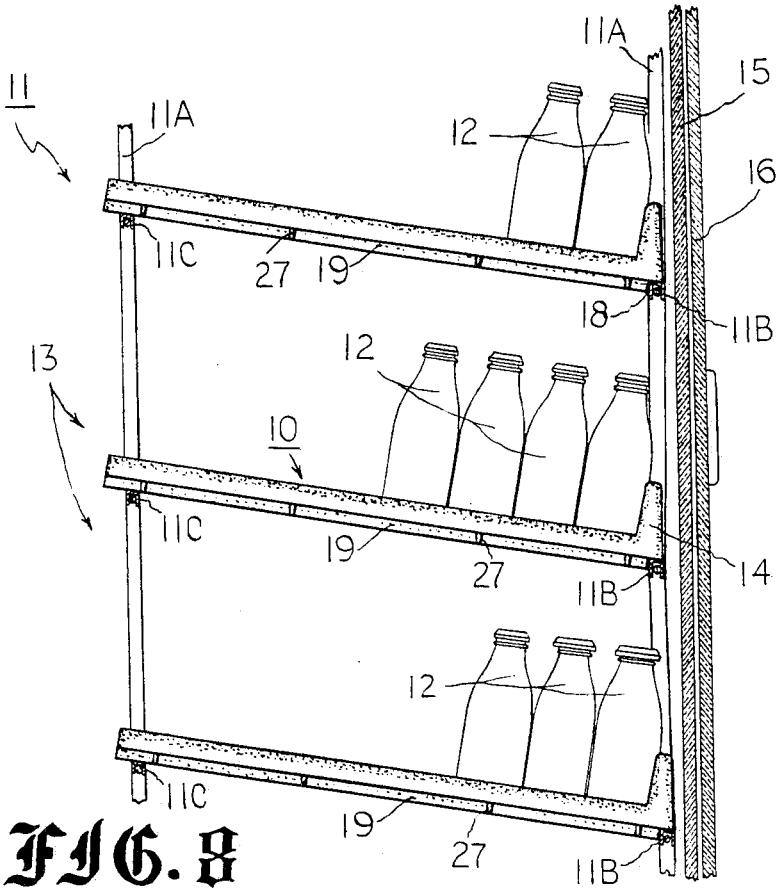
FIG. 8 is a side view of three of the improved dispenser assemblies in a stacked and inclined relationship on support framework within a cooled display cabinet, together with beverage containers.
Figure 5:
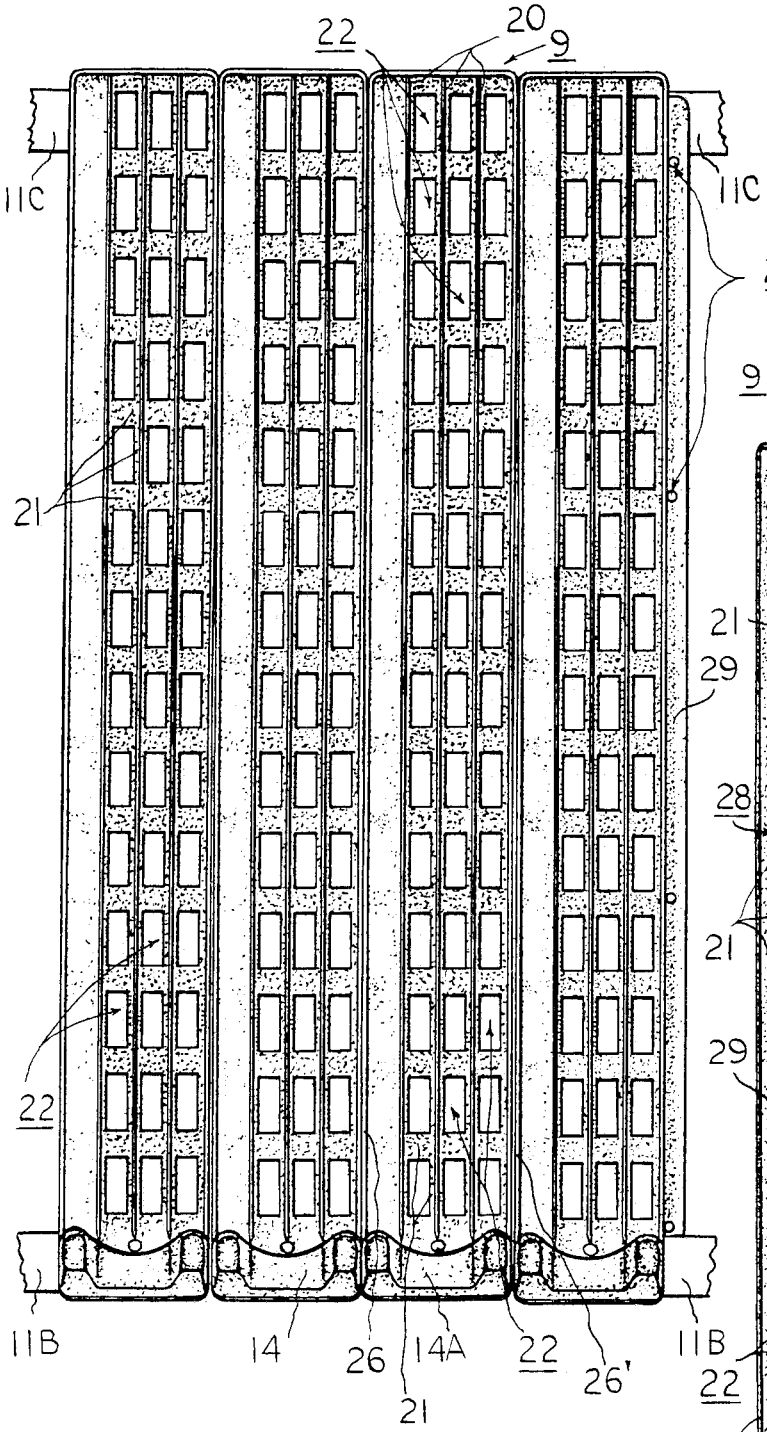
FIG. 5 provides a top plan view of three of the laterally-interlocked elements of a multi-lane dispenser, together with dashed-linework outlines of beverage containers, and with fragments of support framework.
Figure 6:
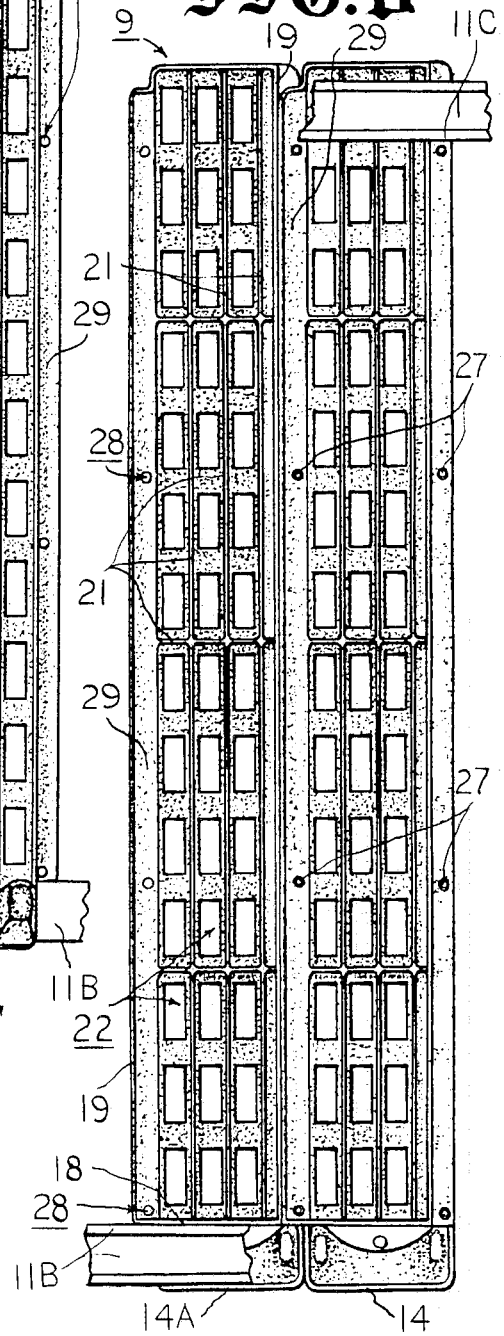
FIG. 6 views two of the interlocked elements of the FIG. 5 dispenser arrangement and their support framework, from below.

Having reference to the drawings, wherein like reference characters designate identical or corresponding components and units throughout the several views, and more particularly to FIGS. 1 and 2 thereof, the perspective showings there are of substantially identical molded-plastic modular elements, 9 and 10, which interlock contiguously in side-by-side relationship to create a special form of selectable-width shelving intended for use in gravity-feed type dispensers of beverage containers. In a typical application and installation, shown in the side view of FIG. 8, modules such as 10 are included as part of a forwardly-inclined shelf of a gravity-feed display-and-dispensing rack arrangement, 11, whose metal uprights 11A and lowermore forward and uppermore rear crossrails, 11B and 11C respectively, help to form a sturdy rigid framework for several vertically-stacked shelves (three such shelves being illustrated). Upright bottles of beverage, 12, are arrayed in rows in the sliding lanes provided by each of the sloping modules, having been set in place from the rear of the rack, 13, and having gravitated downwardly forward toward the front, where their slow sliding motion is halted by a short front wall or stop provided at that end of the modules. Such a front wall, 14 (FIGS. 2 and 8) and 14A (FIG. 1), may be of the illustrated "U" form, which braces the upright bottles well while at the same time allowing the prospective customer to have adequate views of the attractive bottles, contents and markings. In a common setting, the rack is within a refrigerated chamber, closed by sliding glass doors, 15 and 16, through which the fronts of the shelves and the bottles there may be displayed to potential customers; removal of the front bottle from any lane results in gravity-induced forward sliding of the remaining bottles, such that unfilled spaces will not ordinarily appear at the front. The differences in heights of the front and rear shelf-supporting crossrails need only be relatively slight, inasmuch as a forward lane sloping of as little as about ten degrees, or even less, can suffice to insure that bottles will slide forward reliably without any real hazard of breakage in the process. At their front ends, below the front walls 14, 14A and the like, the modules are relieved, as at 17, so that the front end surfaces 18 of their shallow base rimming 19 (FIGS. 1,3,4,6,7 and 8) may catch with the front crossrails 11B (FIG. 8) to prevent the modules from sliding off the crossrails.

Desired forward sliding of the bottles themselves is promoted by smooth shallow plastic rails, such as the three laterally-spaced rails 20 (FIGS. 1,2,5 and 7), which project slightly above the floor of the sliding lane provided by the module 9. Those smooth even-height rounded rails are particularly helpful when, as shown, the main part of the module flooring is an irregular open-mesh type network of molded structural ribbing, 21 (FIGS. 1,2,5,6 and 7); such ribbing affords good structural strength and conserves weight, while the many openings 22 (FIGS. 1,2,5,6 and 7) between the ribs allow chilled air in a refrigerated display chamber to circulate well around the stored bottles awaiting selection by customers.

Typically, a module such as 9 may have an overall length, 23, for its lane length and for the rimmed base portion 19, of about twenty-one inches, with a lane width, 24, of about two-and-three-quarters inches. Its front wall portion 14 may project forward with an overhang, 25, before the front end 18, of about one-and-one-quarter inches. Beverage bottles 12 with a base diameter of about two-and-a half inches fit well within the sliding lane, bounded and guided on both sides by thin guide walls such as the guide 26 which stands about three-eights of an inch above the lane floor. It will be observed that each module possesses but a single such guide wall, shown at the extreme left margin in the case of the element 9 and like elements portrayed in the drawings. However, when two such modules are locked in a side-by-side contiguous relationship, as appears in FIGS. 2,5 and 7, the corresponding guide wall, such as 26', of the neighboring module serves to define the other side margin of the lane and to keep the bottles in their place.

Each module also has integral fastening provisions which serve to interlock them together to form shelving of desired variable widths fitting whatever rack widths the merchandizer has or makes available. In a preferred expression, those fastening provisions include a series (such as four) downwardly-projecting pegs, 27, along one side edge of each elongated module, and a matched series of recesses or holes, 28, distributed along the opposite edge. Preferably, the pegs are slightly tapered, and they make firm frictional engagements with the boundaries of the holes when mated within them. Such mating necessarily involves the pegs of one module and the holes in a neighboring module, of course. To avoid waste of valuable space for the shelving, adjacent lanes should not be spaced laterally by any substantial amount, and that is the case when the fasteners used to secure them together do not take up such lateral space. For such reasons, each module is of a non-symmetrical configuration which allows for overlap of one side edge, from which the pegs 27 depend, over the opposite interfitting ledge-like side edge 29 of its neighboring module,which exhibits the locking holes 28; when two such modules are interlocked by snap-fitting the pegs of one into the ledge holes of the other, their lanes for the bottles are advantageously close together, with little space between them. Further, as is shown in the FIG. 7 cross-sectioning, the interlocked modules fit together with sides of their bases 19 abutting one another, and with the top of each ledge abutting the bottom of the overlapping edge of its neighbor; such complementary shaping and proportioning results in a mated edge fitting which further imparts desirable strength and rigidity to the shelves as they are assembled from the modules.

Each module lends itself to molding from a plastic having good surface lubricity characteristics, as a single-piece unitary item, inclusive of pegs, front wall, and so on. In other arrangements, the modules may have upstanding guide walls on both sides of their lanes, and may include more than a single lane, because they tend to be relatively narrow, and double-lane units can still afford much flexibility in assembling variable-width shelving, for example. The front walls or stops need not have the illustrated configuration, and the same is true of the floor openings, which may be circular, oval, or in the form of perforations. Nor need the pegs and recesses be cylindrical and circular, as other shapes and interlocking actions may function to yield similar useful results; such modified elements may slide together to interlock along their edges, rather than fit by being pressed together, for example. Similarly, the modules may of course be rested upon or fitted with rack structure other than as shown, depending upon the user's needs and interests.

Accordingly, it should be understood that the specific embodiments and practices described in connection with this specification have been presented by way of disclosure rather than limitation, and that various modifications, combinations and substitutions may be effected by those skilled in the art without departure either in spirit or scope from this invention in its broader aspects and as set forth in the appended claims.

What we claim as new and desire to secure by Letters Patent of the United States is:

1. A shelf module for assembly with at least one like module to form a wider selectable-width shelf on which at least one row of beverage containers may be arranged to slide under influence of gravity to a front of said shelf module for removal therefrom when said shelf is mounted on a rack with a forward incline, comprising a relatively long and narrow one-piece molded-plastic modular element having a substantially flat floor with a plurality of openings therethrough and an elongated guide wall of relatively-low height upstanding in relations to and integral with said floor extending substantially without interruption directly along one elongated marginal side edge of said modular element, the opposite parallel marginal side edge of said element being free of an upstanding wall and not extending substantially above the level of said floor, said floor having parallel rails of lower height than said guide wall extending substantially fully longitudinally therealong parallel with said guide wall and forming therewith a relatively long and narrow lane adapted to have beverage containers slide forward in said lane under influence of gravity when said lane has said forward incline, a front wall extending upwardly at the forward end of said lane and serving as a stop to limit sliding movements of beverage containers in said lane, said modular element having vertically-extending side surfaces alongside both of said marginal side edges disposed to abut with vertically-extending side surfaces of other like modular elements when they are fitted in substantially contiguous side-by-side relationship, and complementary cooperating interlocking provisions disposed along each of the two sides of said modular element and integral therewith, said interlocking provisions including male and female connector means proportioned and arranged for those along each of the two sides of the modular element to engage and hold firmly with like connectors along the sides of other substantially identical modular elements fitted therewith by way of vertical relative motion between the modular elements which brings said side surfaces into said side-byside relationship, whereby shelving of desired width may be assembled by vertically fitting said modular element with others like it in a laterally-interlocked rigid composite structure by way of said interlocking provisions and without use of auxiliary fasteners.

2. A shelf module for assembly with at least one like module as set forth in claim 1 wherein said two sides of said modular element are at least in part laterally extended and relieved, respectively, so that one forms a laterally-extended overhang and the other a laterally-extending underslung ledge, whereby said two sides fit closely over and under similar sides of the other like modular elements when interlocked therewith.

3. A shelf module for assembly with at least one like module as set forth in claim 6 wherein said male and female connectors of said locking provisions are integral with said overhang and said ledge and include vertically-extending pegs and vertically-oriented recesses proportioned to receive pegs like said pegs in firmly fitted relation.

* * * * *